United States Patent [19]

Richardson

[11] Patent Number: 4,798,387

[45] Date of Patent: Jan. 17, 1989

[54] MULTIPLE BINGO GAMING BOARD

[75] Inventor: John Richardson, San Diego, Calif.

[73] Assignee: Selectro-Vision, Ltd., San Diego, Calif.

[21] Appl. No.: 4,294

[22] Filed: Jan. 5, 1987

Related U.S. Application Data

[63] Continuation of Ser. No. 441,771, Nov. 15, 1982, abandoned, Continuation-in-part of Ser. No. 079,807, Sep. 28, 1979, Pat. No. 4,365,810.

[51] Int. Cl.[4] ..... A63F 3/06

[52] U.S. Cl. ..... 273/237; 273/269

[58] Field of Search ..... 273/237, 238, 269, 138 A, 273/1 E, 1 ES, 85 CP; 434/200, 201; 364/410–412

[56] References Cited

U.S. PATENT DOCUMENTS

| | | | |
|---|---|---|---|
| 3,653,026 | 3/1972 | Hurley | 273/139 |
| 3,895,807 | 7/1975 | Friedman | 273/138 A |
| 4,121,830 | 10/1978 | Buckley | 273/138 A |
| 4,222,571 | 9/1980 | Molat | 273/269 |
| 4,365,810 | 12/1982 | Richardson | 273/237 |
| 4,378,940 | 4/1983 | Gluz et al. | 273/269 |
| 4,398,086 | 8/1983 | Smith, III | 273/1 E |
| 4,415,153 | 11/1983 | Yokoi | 273/1 GC |
| 4,421,487 | 12/1983 | Laughon et al. | 273/237 |
| 4,436,308 | 3/1984 | Rose et al. | 273/237 |
| 4,475,157 | 10/1984 | Bolan | 273/269 |
| 4,651,995 | 3/1987 | Henkel | 273/269 |

OTHER PUBLICATIONS

"Bingo", *Basic Computer Games*, ©1975, pp. 36 & 37.

*Primary Examiner*—Maryann Lastova

*Attorney, Agent, or Firm*—Fitch, Even, Tabin & Flannery

[57] ABSTRACT

A gaming board for recording numbers, letters and/or other symbols which are selected at random during the game by the game operator is disclosed; the gaming board has the capacity to display and record several symbolic arrays, each of which has been predetermined and inputted by the game player prior to the start of the game; the board also provides for the recording and display of subarrays of a specified shape or character any one of which, if completed as a result of the selection of random numbers which correspond to the predetermined numbers prior to or simultaneous with another player completing the subarray, wins the game; the board further provides for the input by the game player of the randomly selected symbols in such a way as to be recorded on each of the several predetermined arrays.

15 Claims, 4 Drawing Sheets

MULTIPLE BINGO GAMING BOARD

This application is a continuation of application Ser. No. 441,771, now abandoned, filed Nov. 15, 1982, for Multiple Gaming Board. Application Ser. No. 441,771 is a continuation-in-part of application Ser. No. 079,807, filed Sept. 28, 1979, for Gaming Board, now Richardson U.S. Pat. No. 4,365,810, issued Dec. 28, 1982. The disclosure of the Richardson patent is hereby expressly incorporated herein by reference.

The present invention relates generally to an improved gaming board for use in games such as BINGO, and more specifically to a gaming board of the type disclosed in the above noted Richardson Patent. The present invention provides a gaming board with a single display but with the capability of recording multiple arrays of symbols of the player's preference, each of which can be called up on the visual display at the player's discretion. Numbers are randomly drawn by the game operator and the shape of the winning array is selected by the game operator. The board will display an indication of what numbers remain to be randomly drawn by the game operator to yield a winning board.

In Bingo and similar games of chance the basic elements of the game are a gaming board and a random number generating device. The gaming board can be a square array of numbers, usually a 5×5 array, with the centermost location being blank or termed "free". The game is played generally with either 75 or 90 numbers, and each column in the array is limited to only one-fifth of the numbers; e.g., the first column would be taken from the group 1 to 15 in the event 75 numbers are being selected and from 1 to 18 if it is 90; the second column would be taken from the group 16 to 30 or 19 to 36, and so on. Further, duplicate numbers cannot and should not appear on the gaming board. When the game is being played, the game operator specifies a shape or pattern to be formed on the gaming board by the randomly drawn numbers and then proceeds to call numbers at random between 1 and 75 or 90, whichever is appropriate. If a number called coincides with one on the player's board, the player then marks the number in some fashion on his board. The object of the game is to be the first player to have the randomly called numbers coincide with the preselected numbers on the player's board so as to form the specified shape or pattern. The specified shape or pattern may be an "X", "T", "L", a diagonal line, any five numbers horizontally or vertically, and so on.

Several games of between about twelve and eighteen constitute a Bingo program which is played during the course of an evening of several hours. The games are played consecutively and essentially without any major interruption except for possible intermissions.

These games have long been played with boards which have a fixed printed numerical array. Players have generally been unable to create and play with an array of their own choosing and determination and have been limited to selecting from a large number of these fixed printed boards. In order to provide themselves with a greater opportunity to win, players prefer to play with several different arrays. The use by players of more than one board is also advantageous to the game operator in that he collects a charge for each board used. However, the use of many boards by a single player takes up space which might otherwise be used to accommodate another player. Further, the use of many such bo ards by a single player can slow the overall program to the discontent of other players. In addition, many players would like to play with more boards but are limited by their own dexterity and inability to see and follow more than one or two boards. Further, because generally each game during a normal Bingo program varies as far as the shape which the winning array must take, it is desirable for the player to have the ability to have the shape of the winning array promptly displayed on his board and, further, to be provided with an automatic indication of when that array has been achieved. The gaming board disclosed in the above related Richardson patent provides a board which gives the player the flexibility of being able to promptly input his own predetermined array of symbols with which to play during all or a substantial part of a Bingo program.

Accordingly, it is an object of the present invention to provide a gaming board for use in games akin to Bingo which enables the player, on a single board, to promptly input more than one of his own predetermined arrays of symbols with which to play.

Another object of the present invention is to provide such a board which allows the player with a single entry to record a randomly called number on all of his predetermined arrays of symbols.

Another object of the present invention is to provide such a board which has a built-in safeguard which protects the player from inputting numbers which are out of limit for the location in the array of which are duplications in a given array.

Another object of the present invention is to provide such a board which secures the player's inputted array so that it cannot be modified or otherwise changed until the operator of the program permits the change.

Another object is to provide such a board which generally displays the shape of the array to be formed from the randomly called numbers.

Another object is to provide such a board which allows the player to display any one of his predetermined arrays and indicate what numbers must be randomly drawn by the game operators to yield a winning array.

Another object is to provide such a board which signals the player when a winning array has been achieved on his board and displays the winning array.

These and other objects and advantages of the present invention will become apparent upon reading the following detailed description, while referring to the attached drawings, in which.

Figure 3A:
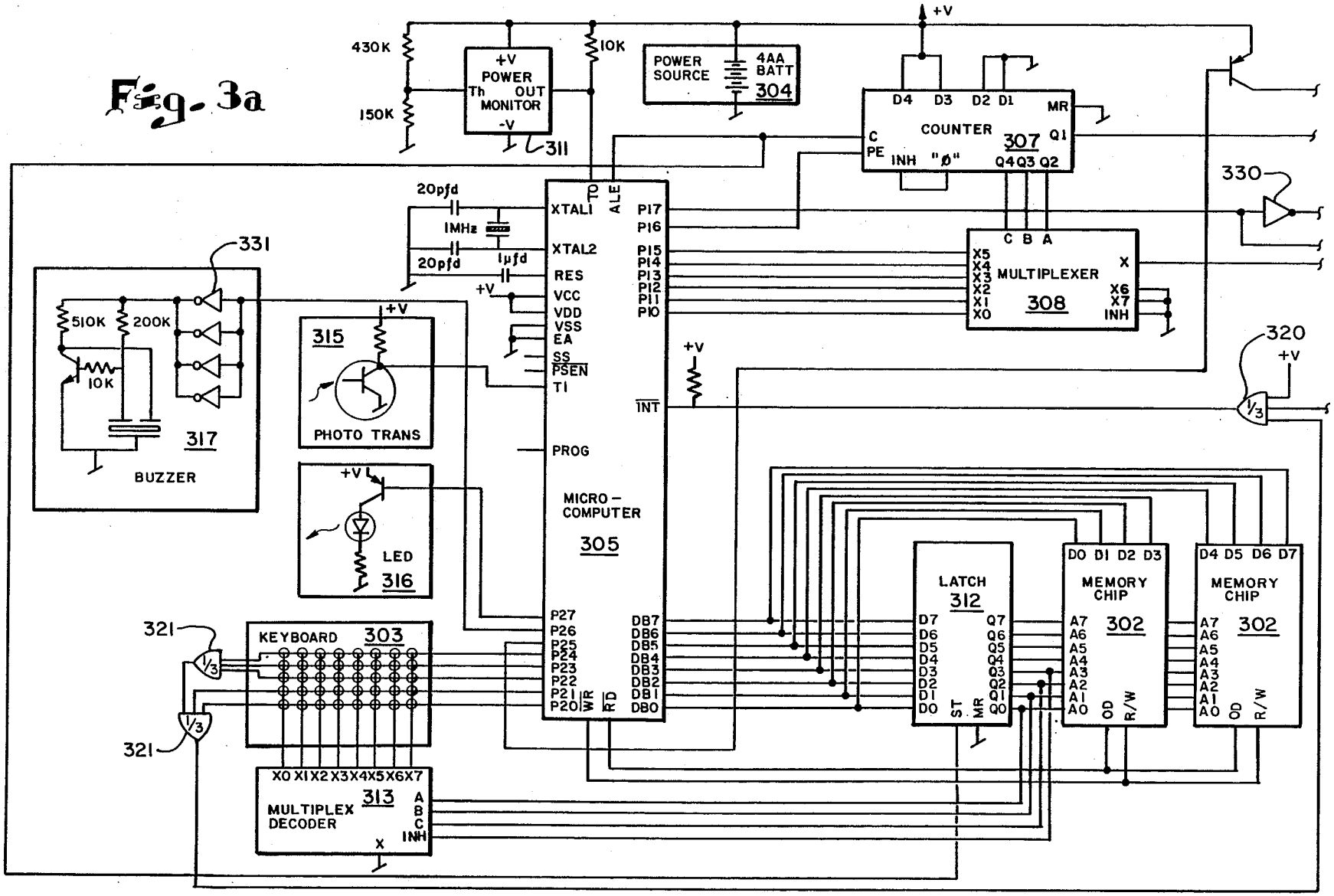
Figure 3B:
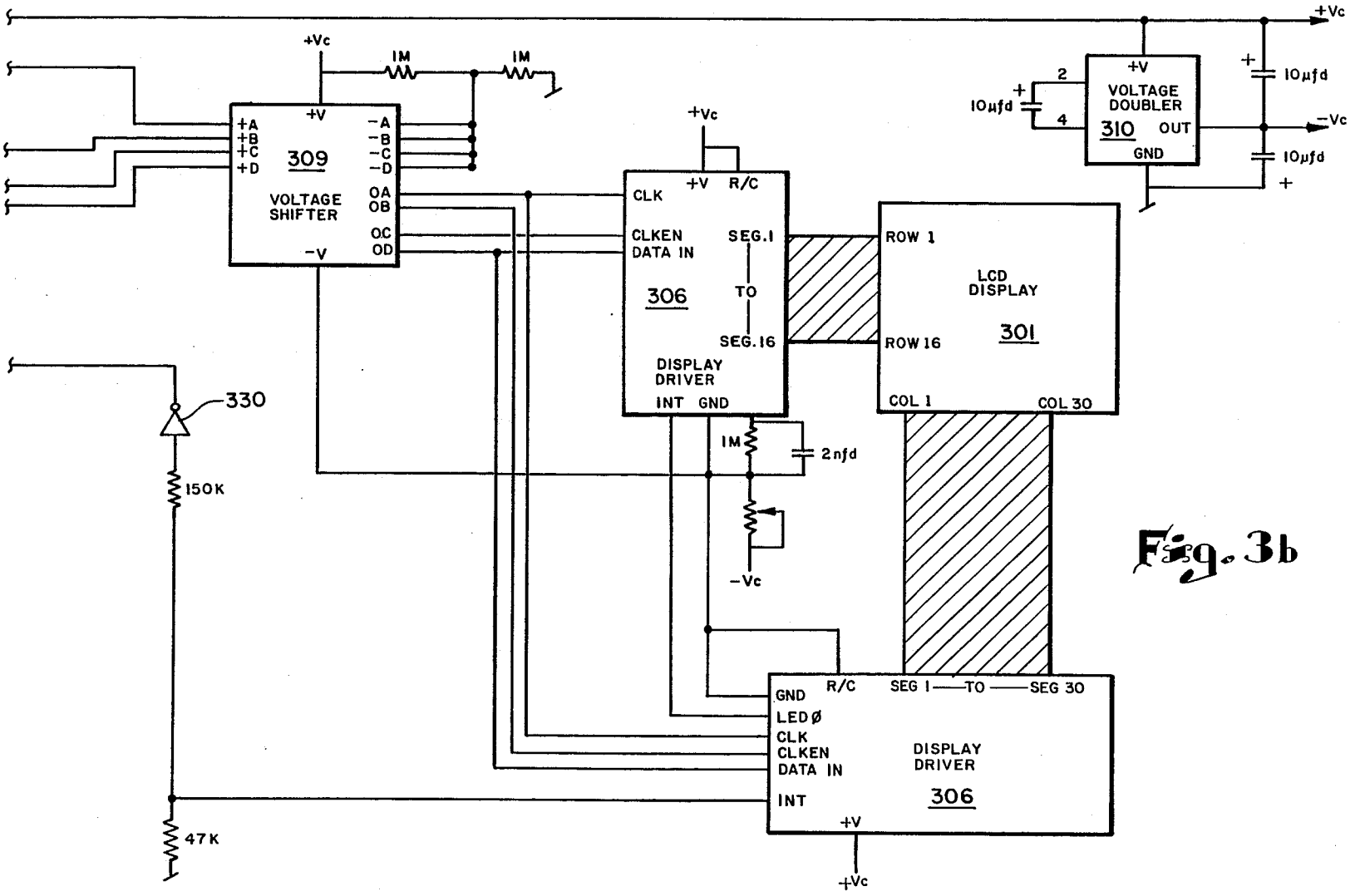

FIG. 3*a* and FIG. 3*b* together comprise an electrical schematic diagram of the present invention which utilizes liquid crystal displays as the display means.

The gaming board may be used to display numbers, alphabetic letters, or any other symbols which can be simulated using the display means. The present invention herein described utilizes numbers but is not intended to be limited to such. The specific embodiment shown herein provides a gaming board having a 5×5 array of display means; the shape or size of the array which the present invention may take is not intended to be limited to such. While the primary embodiment depicted makes use of liquid crystal displays (LCD's) as the display means, other devices such as light emitting diodes (LED's) or other electronic display devices can be substituted.

Figure 1:
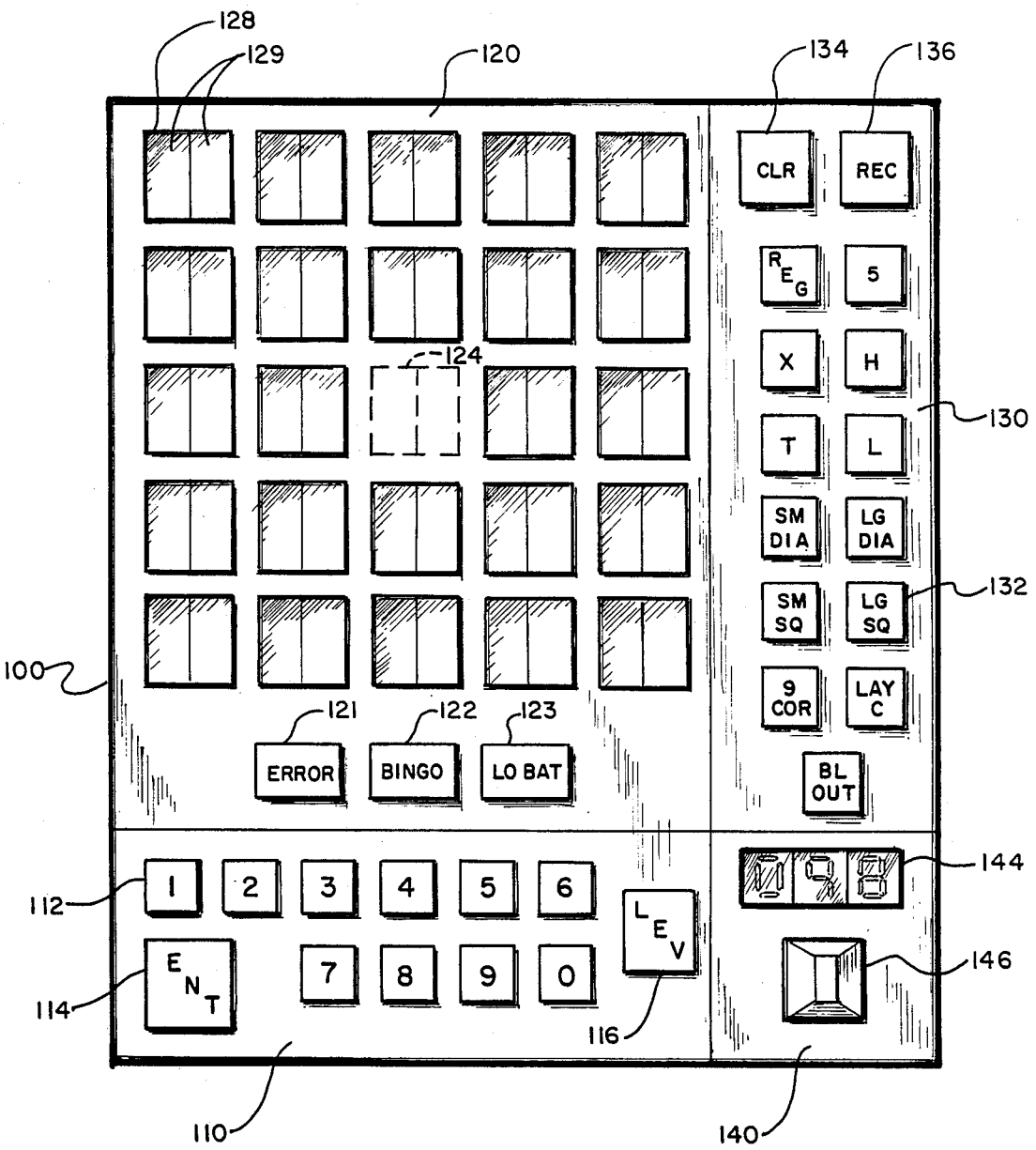
FIG. 1 is a plan view of the gaming board embodying the present invention.

FIG. 1 depicts a plan view of the overall gaming board. The gaming board 100 is essentially divided into three main parts: first, the number input part 110; second, the display part 120; and third, the game selection part 130. A fourth part of the gaming board is the security part of the board 140 which contains a serial input slot 146 for the game operator's electronics communications device that will be described later.

The board operates in two modes—a load mode and a play mode. During the load mode the numerical arrays selected by the player are inputted one array at a time into the display part 120 one number at a time by depressing the appropriate keys in the number input part 110. The center location of the display 124 provides a visual indication of the level or array number being loaded and automatically increases as each array loading is completed. The player has a given amount of time to input the arrays. If the time limit is exceeded, the board must be reset by the operator before number input can be proceed. A visual indication of the time remaining 144 can also be provided. When all the numbers have been inputted for the given array, the board automatically stores that array, blanks out the display and then allows the first number for the next array to be loaded. When the last array has been inputted, the board automatically shifts to the play mode.

During the play mode, the player may input the type of game to be played using the game selection part 130 which was inoperative during the load mode. In the play mode, the function of the number input part 110 changes and becomes the means by which the player inputs the game-operator-called number by depressing the appropriate key or keys 112 and the entry key 114. A single entry marks the number present on each of a player's arrays even if it is not being displayed at the time. When the winning game shape has been achieved, a buzzer sounds and the "bingo" annunciator 122 is displayed as well as the winning array while the other numbers are blanked, thereby clearly indicating immediately to the player that he has won.

The input slot or port 146 is a recessed cavity providing access to an LED and a phototransistor for transmitting and receiving data, respectively. An electronic communications device available only to the game operator fits into this slot and with an LED transmitter and phototransistor receiver of its own, sends and receives data from the gaming board. In this way, the game operator may activate and reset the board so the arrays may be filled with new numbers, set the number of arrays that may be displayed, and load a secret validating security code for that particular gaming session. When a player wins, the secret code may be read back by the same device to check the validity of the board.

The number input part of the gaming baord 110 comprises a keyboard of ten selection keys 112, which cover the digits 0 to 9 inclusively, a level key 116, and an entry key 114. During the load mode, the numbers for a given array are loaded in a predetermined sequence: from the top to the bottom of each column going from left to right. As each number is entered, it appears on the display part 120 at the location being loaded. If the number loaded is a duplicate or outside the range allowed for the location, the "error" annunciator 121 is displayed and pressing the entry key 114 only erases the number for a retry. If the number meets the limitations of the game as noted, pressing the entry key fixes the number in the gaming board's memory and the next location is then offered for entry. This procedure continues until all the allowed arrays have been completed. A random number selection key may also be provided in the event a particular number is not desired. Pressing this key will cause a pseudorandom number to be generated by the microprocessor meeting all the proper game criteria be loaded into the given location.

During the play mode, the number input part of the gaming board 110 is used to record a plurality of randomly called numbers. As the randomly called number is typed in, it appears in the center location of the display 124. The number is then entered by pressing the entry key 114. As mentioned above, the board then searches all of the player arrays and marks that number where it appears in each of them for purposes of a winning pattern match determining when these arrays are subsequently displayed, the location where that number appears will be blanked out or otherwise marked. After the number is entered, the level number of the array being displayed will again appear in the center location 124. Each time the level key 116 is pressed, the next consecutive level is displayed until the highest level allowed, which is then followed by level 1.

The display part of the gaming board 120 comprises twenty-four symbol display locations 128 with each location containing a two digit number 129, a row of annunciators 121 through 123 at the bottom of the gaming board which provides various information to the player, and a level or array number indicator 124 in the center of the display. The annunciators can signal an Error, Bingo, or Lobat condition. The Error display 121 indicates to the player during the load mode that the number in the display location to be loaded does not meet all conditions. The Bingo display 122 announces a winning pattern, and the Lobat display 123 warns the player that the battery that powers the gaming board is becoming weak and should be replaced.

The game selection part of the game board 130 comprises thirteen game type or pattern selection keys 132, a clear key 134, and a recall key 136, generally in the form of a keyboard. By depressing a pattern selection key 132, the player inputs the particular pattern specified by the game operator which the randomly called numbers must form on the arrays to constitute a win. The clear key 134 will cause the numbers which have been marked and blanked out or dimmed during the prior game to be reactivated on all the stored arrays. The game pattern remains the same after the clear key has been depressed and is changed by depressing another pattern key. The recall key 136, so long as the key is depressed, displays all the numbers on the board for the array or level being presented, enabling the player to see what numbers have been blanked on that particular level. The other keys 132 operate as described in the referenced Richardson patent.

Figure 2:
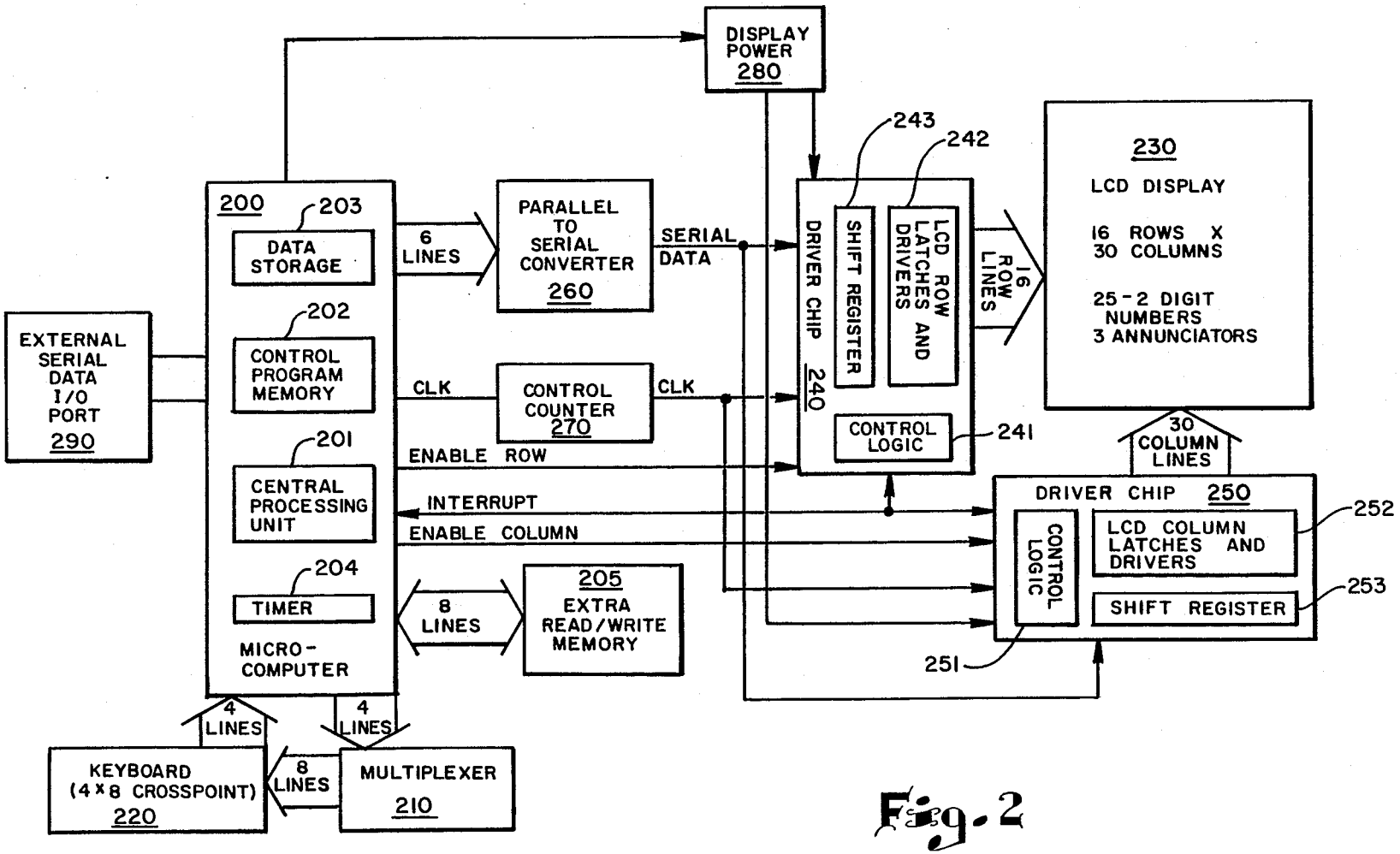
FIG. 2 is a simplified block diagram illustrating the general components and circuitry of a gaming board embodying the present invention.

FIG. 2 provides a simplified block diagram of the essential components and circuitry of a gaming board embodying the present invention which uses a liquid crystal display (LCD). A microprocessor 200 contains a software program that controls the operation of the gaming board. The microprocessor 200 comprises a central processing unit 201, a non-volatile memory 202 into which the control program is masked, data storage capabilities 203, and a timer 204. A multiplexer 210 provides scanning signals to the 4×8 crosspoint keyboard 220 enabling the microcomputer 200 to decode which key was pressed. The data, or numbers, for each array are stored in the extra read/write memory 205 which may be a part of the microprocessor 200. The array that is actually being displayed is copied at the direction of the control program to the data storage 203 for quick access by the microcomputer. An LCD display 230, which consists of a 5×5 array of numbers and a row of annunciators, is formed from 16 row electrodes crossed by 30 column electrodes which are separated by the liquid crystal material. The points where the rows and columns cross are shaped to form the segments of the numbers (three rows and three columns per digit) and the annunciators. The average voltage applied between a column and row electrode determines whether the segment at their intersection is displayed or not. These voltages are supplied by the LCD driver chips 240 and 250, each of which contain control logic 241 and 251 which multiplex the column voltages to the LCD display one row at a time, refreshing all 16 rows at a minimum of 30 Hertz. The column and row information must be serially sent to the LCD display drivers 242 and 252; this is most efficiently done by using a parallel-to-serial converter 260 to convert 6-bit parallel data from the microprocessor's port to serial data that is then shifted by means of the control counter 270 into the shift registers 243 and 253 contained in the LCD display drivers 240 and 250. All the digital logic is designed using extremely low power complementary-metal-oxide-semiconductor technology, including the microprocessor. The design is intended to use such low power that even though the power is constantly supplied to the circuitry, under normal usage the batteries that power the board will last many months. To aid in this goal, the microprocessor 200 will turn off the power 280 to the LCD display drivers 240 and 250 and enter a low power idle mode if a key is not pressed after a given period of time. The numbers for the arrays remain stored in memory and the display can be turned back on by pressing any key 112 on the keyboard. Finally, an external serial data I/O port 290 provides access for communication between the microprocessor 200 and the operator's serial communication device described earlier.

The basic operation behind a gaming board which embodies the present invention is depicted in FIGS. *3a*, *3b*, *3c* and *3d* of the above related Richardson patent. These figures provide a flow diagram contained in memory of the control program 202 of the microcomputer 200 shown in FIG. 2. The program required to operate the herein described gaming board is in essence the same as that described in the above related case except for the multi-level operation and the LCD display. The red and green LED's noted in the related case and herein replaced by the Error 121 and Bingo 122 indicators. The control routine is modified to provide for a looping operation during the load mode to accomodate loading of more than one array, i.e., when all the numbers for a given array have been loaded, a level check is added so that if all levels have not been completed, the display is blanked and new storage memory locations are addressed corresponding to the next level, or array, to be entered. When all arrays have been loaded, a load mode flag is set to zero. When the load mode flag is set to zero, the blanking routine is now operative for numbers entered from the keyboard. This routine must now search all the inputted arrays, blanking or otherwise marking each location that matches the entered number. In addition, the win-test routine must check all the arrays for a winning match. A new "level routine" is required to respond to the level key 116 by replacing the display memory with the numbers from the next sequential level in storage memory, or looping back to the first level if the highest level allowed was the one most currently displayed.

Lastly, the time interrupt routine that refreshes the display must be changed to accomodate the change to an LCD display. This interrupt routine is now called not by the timer 204 but by an interrupt signal from one of the LCD display drivers, 240 or 250, indicating that the information for the next row and column must be loaded. Since a single LCD row only contains parts of the segments of a row of numbers (3 LCD rows make a row of digits), the digits to be displayed, which are stored in memory as binary coded decimal digits, must be translated with data look-up tables to the proper row and column output for the LCD row refresh.

FIG. *3a* and FIG. *3b* together provide the electrical schematic for a low power multilevel game board with LCD display that embodies the present invention. The embodiment comprises eleven principal components: the LCD display 301, two supplemental memory chips for multi-level operation 302, keyboard 303, microcomputer 305, two display drivers 306, counter 307, multiplexer 308, address latch 312 and keyboard multiplexer/decoder 313. Although the LCD display 301 can only display one game array, or level, at a time (in this embodiment a 5×5 array of two digit numbers), supplemental semiconductor memory chips 302 provide the capacity of storing up to 10 levels that may all be played simultaneously and called up one at a time for inspection by the player. These memory chips are CMOS (complementary-metal-oxide-semiconductor) 256×4 static RAMs (random-access-memories), available from several companies. One example is the HM-6551 by Harris Semiconductor of Melbourne, Fla.

The player inputs information into the gaming board through a crosspoint keyboard 303. The numbered keys on the keyboard 303 which correspond to those shown on the number input part 110 of FIG. 1 serve to load numbers during the load mode, and also to mark numbers as they are specified by the game operator during the play mode. In this way, the specified number can be marked simultaneously on all game levels that contain the number, irrespective of the position of the number in the array.

As noted above, this embodiment uses very little power and can run for months on its four AA battery power source 304. This is because it uses an LCD display, the microcomputer 305 enters an extremely low power idle state when not updating the LCD display or servicing the keyboard, the LCD display 301 is turned off after several minutes of keyboard inactivity and all semiconductor components are low power CMOS parts. Specifically, the multiplexers 308 and 313 are CMOS 4051 units, the latch 312 is a CMOS 4508 unit, the counter 307 is a CMOS 4526 unit the "AND" gates 320 and 321 and inverter gates 330 and 331 are parts CMOS 4073 and CMOS 4069, respectively. The CMOS 4000 notation is a series of industry standard part numbers. These parts are manufactured by several companies, including Motorola and RCA. The voltage lever shifter 309 is a Motorola quad low power operational amplifier, model number 14575. The microcomputer 305 is a model 80C49 CMOS single chip microprocessor manufactured by Intel of Santa Clara, Calif. The pinouts and functions for the microcomputer 305 are similar to those described in the related Richardson patent for the microcomputer identified as 406 when discussing FIGS. 4*a* and 4*b* therein. The CMOS LCD display drivers 306 are HLCD 540's made by Hughes Aircraft of Newport Beach, Calif. The voltage doubler 310 and power monitor 311 are ICL 7660 and ICL 8211 CMOS devices, respectively, made by Intersil of Santa Clara, Calif.

The microcomputer 305 scans the keyboard 303 using the address latch 312 a keyboard multiplexer 313 and input port lines P20–P24. These inputs are processed under the control of the program that was masked onto the microcomputer's ROM (read-only-memory) when the chip was manufactured.

The control program sends data to, and retrieves data from, both the microcomputer's internal storage and the supplemental multilevel memory chips 302. Symbols selected by the player during the load mode and their location are stored in memory chips 302 in symbol storage locations for each level array. During the play mode, the symbol storage locations, containing symbols selected by the player through keyboard 303, during the load mode and which correspond to symbols called by the game operator are marked. The game array pattern selected by the player is stored in array pattern storage locations in the internal data storage of microcomputer 305. When a given level or array is displayed, its numbers or symbols are copied into the fast access read/-write memory on the microcomputer chip 305 itself and those which have been marked are caused to be displayed in a manner which differs from those which have not been marked. The parallel-to-serial converter 260 of FIG. 2 is multiplexer 308 that is controlled by the counter 307 and feeds data to the driver 306. The counter 307 also provides the bit shifting clock pulses to the LCD display drivers 306. These drivers cause the appropriate array to be displayed. The counter 307 in turn is controlled by the microcomputer 305.

The power supply 304 provides a supply voltage of 4–6 volts, and voltage doubler 310 which doubles the battery voltage and provides a supply voltage of 8–12 volts. Voltage shifter 309 shifts voltage supply levels from the 4–6 volts which is used by the microcomputer logic to the 8–12 volts needed by the LCD display 301 and drivers 306. The voltage monitor 311 signals the microcomputer when the voltage is low, which in turn will cause the LOBAT indicator 123 to appear. The main AND gate 320 signals the microcomputer 305 if the keyboard is pressed or if the display needs servicing. The two keyboard "and" gates 321 monitor all keys and signal AND gate 320 when a key is pressed.

The phototransistor 315 and LED 316 serve the function of reading and communicating through the input port 146 in FIG. 1 with the game operator's electronic communication device. Finally, a buzzer 317 provides an audible feedback which indicates to the player that a key has been pressed and also can indicate other conditions of importance to the player such as a Win or Bingo. Inverters 330 provide for proper signal polarity while buzzer inverters 331 provide for sufficient power gain to drive the buzzer 317.

While the present embodiment uses a single keyboard to input the player selected symbols during the load mode, as well as the randomly called symbols during the play mode, it is evident that separate keyboards may be used. Further, the blanking switches described and shown as 122 in FIG. 1 of the related Richardson patent may also be used in a multilevel game board to enter the randomly called symbol. In this later embodiment, the player would have to check other levels or arrays in the event the randomly called number did not appear in the array being displayed. If the symbol did appear and the blanking switch were activated, the board could mark all locations in other arrays in which the symbol was stored or could just mark the one array displayed, thereby requiring the player to search and mark each array.

Various embodiments other than those shown and described herein will become apparent to those skilled in the art from the foregoing description and accompanying drawings. Such other embodiments and modifications, equivalents, and alternates thereof are intended to fall within the scope of the appended claims.

Various features of the invention are set forth in the following claims.

What is claimed is:

1. A hand held chance based gaming board comprising:

electronic display means for visually displaying a plurality of symbols from a predetermined array of symbol display locations;

computer means including a control program stored in a memory means, data processor means controlled by said control program, data storage means including a plurality of symbol storage locations, and means for generating control signals;

means for storing a predetermined array pattern;

input switch means for selecting any one of a plurality of symbols;

means for visually indicating a pattern match between said predetermined array pattern and the pattern of symbols stored in said predetermined array of symbol display locations;

means for selecting a first loading mode;

said computer means, in response to said first loading mode, generating control signals causing the present state of said input switch means to be sensed, causing said data storage means to store said selected symbols in a predetermined sequence in said symbol storage locations, and causing said display means to display said selected symbols in corresponding symbol display locations;

means for selecting a second playing mode, said second mode being independent of said first mode;

said computer means, in response to said second playing mode, generating control signals causing each actuation of an input switch means to be sensed, causing each symbol storage location in which said sensed symbol is stored to be identified, causing said identified symbol display location to be compared with said predetermined pattern, and causing said pattern match indicating means to be actuated if a match is detected;

timing means for limiting the length of time of said first game mode;

shut-off means for deactivating said input switch means and said means for selecting said second playing mode; and said computer means, in response to said first loading mode, generating control signals causing the present state of said timing means to be periodically sensed, and causing said shut-off means to deactivate said input switch means and said means for selecting said second playing mode when a limited time allocated for said first loading mode has expired.

2. A gaming board as defined in claim 1 which further comprises:

means for visually distinguishing said predetermined array pattern from said predetermined array of symbol display locations.

3. A gaming board as defined in claim 1 which further comprises:

improper symbol identification means, forming a part of said control program, for precluding the storage of improper symbols in said storage locations means.

4. A gaming board as defined in claim 1 wherein said symbol storage locations store a plurality of predetermined arrays and which further comprises:

array selecting means for selecting one of a plurality of said predetermined arrays; and said computer means, in response to said second playing mode, generating control signals causing each actuation of said array selecting means to be sensed and said display means to visually display said selected and nonselected symbol display locations corresponding to said selected array.

5. A hand held chance based gaming board comprising:

electronic display means for visually displaying a plurality of symbols in a predetermined array of symbol display locations, wherein said predetermined array comprises the shape of a square and wherein the center most symbol display location does not contain a symbol;

computer means including a control program stored in a memory means, data processor means controlled by said control program, data storage means including a plurality of symbol storage locations for storing one or more predetermined symbol arrays, and means for generating control signals;

means for storing a plurality of win patterns;

input switch means for manually selecting any one of a plurality of symbols to specify said predetermined symbol arrays.

array selection means for selecting one of said predetermined symbol arrays;

means for visually indicating a pattern match between said plurality of win patterns and symbols stored in said predetermined symbol arrays;

timing means for limiting the length of time of a first loading mode for selecting said symbols of said predetermined symbol arrays which include a shut-off means for deactivating said input switch means and a switch means which reactivates and initializes said timing means;

means for selecting said first loading mode;

said computer means, in response to said first loading mode, generating control signals causing the present state of said timing means and said input switch means to be sensed, causing said data storage means to store said sensed symbols in a selected sequence in said symbol storage locations for said predetermined symbol arrays, causing said display means to display said sensed symbols in corresponding symbol display locations for each of said predetermined symbol arrays, and causing said shut-off means to deactivate said input switch means when a limited time allocated for said first loading mode has expired;

means for selecting a second playing mode, said second mode being independent of said first mode; and said computer means, in response to said second playing mode, generating control signals causing each actuation of said array selection means to be sensed such that said display means visually displays said one selected symbol array, causing each actuation of an input switch means to be sensed such that each symbol storage location in which said sensed symbol is stored is identified, causing said display means to visually display identified symbol display locations in a manner which differs from the manner in which nonidentified symbol display locations are being displayed for said one selected symbol array, causing matching means to compare said identified locations for each predetermined array with said plurality of win patterns and causing actuating means to actuate said indicating means if a pattern match is detected in any one of the predetermined symbol arrays.

6. A gaming board as defined in claim 5 wherein said electronic display means further comprises:

means for visually distinguishing said plurality of win patterns from said predetermined symbol arrays.

7. A hand held chance based gaming board comprising:

electronic display means for visually displaying a plurality of symbols in a predetermined array of symbol display locations;

computer means including a control program stored in memory means, data processor means controlled by said control program, data storage means including a plurality of symbol storage locations for storing one or more game boards, and means generating control signals;

input switch means for manually selecting any one of a plurality of symbols;

an array symbol switch means including a plurality of actuatable array symbol switches, each switch positioned adjacent a respective one of said symbol display locations for enabling the manual selection of one of said symbols in said array of symbol display locations;

means for selecting a first loading mode;

said computer means, in response to said first loading mode, generating control signals causing the present state of said input switch means to be periodically sensed, said data storage means to store said sensed symbols in a selected sequence in said symbol storage locations, and said display means to display said sensed symbols in corresponding symbol display locations;

means for selecting a second playing mode, said second mode being independent of said first mode;

game board selecting means for selecting one of said one or more stored game boards;

said computer means, in response to said second playing mode, generating control signals causing each actuation of said game board selecting means to be sensed and said display means to visually display said selected game board, causing each actuation of an array symbol switch means to be sensed such that the identity of said sensed switch is stored in said data storage means, and causing said display means to indicate that the sensed array symbol switch corresponding to the symbol display location has been selected, and said display means to visually display the stored array symbol switches in a manner which differs from the manner in which the nonselected array symbol switches are displayed;

timing means for limiting the length of time of said first game mode;

shut-off means for deactivating said input switch means and said means for selecting said second playing mode; and said computer means, in response to said first loading mode, generating control signals causing the present state of said timing means to be periodically sensed, and causing said shut-off means to deactivate said input switch means and said means for selecting said second playing mode when a limited time allocated for said first loading mode has expired.

8. A hand held chance based game board comprising:

electronic display means adapted to visually display a plurality of symbols in a predetermined array of symbol display locations;

random access data storage means including a plurality of symbol storage locations;

symbol input means for arbitrarily selecting any one of said plurality of symbols and for generating a symbol representation thereof;

microprocessor means including a control program stored in a memory means, said microprocessor means executing said control program to thereby generate control signals to said display means, data storage means, and input means;

means for selecting a first loading mode;

said microprocessor means, in response to said first loading mode, generating control signals causing said arbitrarily selected symbol representations from said symbol input means to be stored in a predetermined sequence in said symbol display locations, and generating control signals causing said display means to display said stored symbol representations in corresponding symbol display locations;

means for selecting a second playing mode, said second mode being independent of said first mode;

said microprocessor means, in response to said second playing mode, generating control signals causing said arbitrarily selected symbol representations from said symbol input means to be compared with said stored symbol representations, causing the symbol locations found to contain a match to become marked symbol locations, and causing said symbol display locations corresponding to said marked symbol locations to display a marked symbol representation in a manner which is different from the symbol representation stored for that location;

timing means for limiting the length of time of said first loading mode;

means for deactivating said symbol input means and thereby deactivating said first loading mode and said second playing mode;

said microprocessor means generating control signals during said first loading mode to determine the present state of said timing means and causing said deactivating means to deactivate said symbol input means when said timing means indicates the limited time for said first loading mode has expired; and said microprocessor means generating control signals resetting said timing means and resetting said deactivating means in response to a selection of said first loading mode.

9. A hand held chance based game board as set forth in claim 8 further comprising:

means for selecting an array pattern; and said microprocessor means, in response to said second playing mode, generating control signals causing said marked symbol locations to be compared to said selected array pattern and causing an indication of a pattern match to be generated if the pattern of said marked symbols is identical to the selected pattern.

10. A hand held chance based game board as set forth in claim 8 further comprising:

means for generating a signal to clear said data storage means; and said microprocessor means, in response to said second playing mode and said clear signal, generating control signals to unmark said marked symbol locations.

11. A hand held chance based game board as set forth in claim 8 wherein only a corresponding subset of said plurality of symbols is proper for storage in each symbol location and which further comprises:

improper symbol identification means, forming part of said control program, for precluding the storage of improper symbols in said symbol storage locations; and said improper symbol identification means comparing said symbol representations input from said symbol input means during said first loading mode to said selected subset of symbols to determine if the symbol representation input is improper for a particular symbol location.

12. A hand held chance based game board as set forth in claim 11 wherein said improper symbol identification means further comprises:

duplicate symbol identification means, forming part of said control program, for preventing duplicate symbols from being stored in said symbol storage locations.

13. A hand held chance based game board as set forth in claim 8 which further comprises:

program check means, forming part of said control program, for displaying a program code comprising a combination of symbols on said display means;

said program check means including means for storing said program code, program code storage to store said program code, and code recall means; and wherein said code recall means enables the recall of said program code from said code storage and the display of said program code on said display means in response to an activation of said recall means.

14. A hand held chance based game board as set forth in claim 8 wherein said symbol storage locations include space for a plurality of symbol arrays and which further comprises:

said microprocessor means, in response to said first loading mode, generating control signals causing said arbitrarily selected symbol representations from said symbol input means to be stored in said predetermined sequence for each of said plurality of symbol arrays;

array selecting means for selecting one of said plurality of symbol arrays;

said microprocessor means, in response to said first loading mode or said second playing mode, generating control signals causing said selected one of said plurality of symbol arrays to be displayed; and said microprocessor means, in response to said second playing mode, generating control signals causing said arbitrarily selected symbol representations from said symbol input means to be compared with said stored symbol representations in said plurality of symbol arrays.

15. A hand held electronic Bingo game board comprising:

a keyboard having input keys for generating input numbers, for generating commands, and for generating indications of specific Bingo patterns;

a display comprising a plurality of electronic LCD display units arranged in a Bingo array each of which is adapted to display a number or a blank;

a controller which receives input numbers, commands, and pattern indications from said keyboard and transmits numbers to said display to play a Bingo game;

said controller including a microprocessor, a memory, said means for interfacing said microprocessor to said keyboard, and said memory, and said display; said controller executing a control program with said microprocessor to cause said board to input a plurality of Bingo arrays into memory in a first loading mode and to cause said board to play said plurality of Bingo arrays in a second playing mode, said second mode being operational only at the end of said first mode and independent thereof;

timing means for limiting the length of time of said first loading mode;

means for deactivating said input keys, thereby deactivating said first loading mode and said second playing mode;

said microprocessor generating control signals during said first loading mode to determine the present state of said timing means and causing said deactivating means to deactivate said input keys when said timing means indicates the limited time for said first loading mode has expired; and said microprocessor generating control signals resetting said timing means and resetting said deactivating means in response to a selection of said first loading mode.

* * * * *